US006641192B2

(12) United States Patent
Eschenfelder

(10) Patent No.: US 6,641,192 B2
(45) Date of Patent: Nov. 4, 2003

(54) STORAGE CABINET FOR USE IN A GOLF CART

(76) Inventor: Charles R. Eschenfelder, 1009 Augusta Dr., Lufkin, TX (US) 75901

( * ) Notice: Subject to any disclaimer, the term of this patent is extended or adjusted under 35 U.S.C. 154(b) by 48 days.

(21) Appl. No.: 09/938,785

(22) Filed: Aug. 24, 2001

(65) Prior Publication Data

US 2002/0024272 A1 Feb. 28, 2002

Related U.S. Application Data

(60) Provisional application No. 60/227,788, filed on Aug. 25, 2000.

(51) Int. Cl.[7] ..... B60R 11/00
(52) U.S. Cl. ..... 296/37.1; 224/274; 224/488
(58) Field of Search ..... 296/37.1; 224/488, 224/274

(56) References Cited

U.S. PATENT DOCUMENTS 4,045,103 A * 8/1977 Paolino ..... 312/198
4,344,660 A 8/1982 Molnar et al.
4,383,563 A 5/1983 Kirchhoff, Jr.
4,989,767 A * 2/1991 Buschbom
5,090,526 A 2/1992 Jacober
5,213,364 A 5/1993 Theckston
5,718,301 A 2/1998 Williams
5,788,070 A * 8/1998 Banker
6,183,029 B1 * 2/2001 Deaton
6,321,926 B1 * 11/2001 Allen

* cited by examiner

*Primary Examiner*—Stephen T. Gordon
*Assistant Examiner*—Jason S Morrow
(74) *Attorney, Agent, or Firm*—Bracewell & Patterson, L.L.P.

(57) ABSTRACT

A storage cabinet for use on a golf cart has a body having an upper compartment and a lower compartment. The body is removably attached to and supported by the golf cart. The upper compartment has an upper closure member. The lower compartment has a lower closure member releasably attached to the lower compartment. Each closure member can be hinged to its respective compartment. The body may have a platform between the lower compartment and the golf cart to raise the lower compartment. The lower compartment has shelves. The shelves may be removable or fixed. Removable shelves can be placed at various heights within the lower compartment. The upper compartment is a thermally insulated container, or holds a thermally insulated container.

9 Claims, 2 Drawing Sheets

STORAGE CABINET FOR USE IN A GOLF CART

This application claims the benefit of U.S. Provisional Application No. 60/227,788 filed Aug. 25, 2000.

BACKGROUND OF THE INVENTION

1. Field of the Invention

This invention relates to storage compartments, and more particularly to storage compartments for use in a golf cart.

2. Description of Prior Art

Golf carts are widely used throughout the world to assist golfers in getting around on golf courses. Many avid golfers who live in a planned residential development having a golf course own motorized golf carts and often drive (or trailer) them to and from the course. Other golfers who use a golf cart provided by the course management often drive to and from their parked cars to load and unload equipment, beverages, and other items. Those driving personal carts from home do the same before leaving the house.

Golf requires a lot of equipment to play. Golf clubs, golf balls, and golf tees are indispensable items. Golf shoes and golf gloves are almost universally worn. To play comfortably, many golfers bring extra clothing such as shirts, socks, caps, or sweaters to use depending on weather conditions. An umbrella many times proves useful. Because of the prolonged physical activity, golfers often carry food or beverages along to refresh themselves. Some even pack a few of their favorite cigars or other smoking materials to indulge their cravings while enjoying the great outdoors.

Thus, essentially since the inception of the game, there has always been a need for some way to comfortably carry those items. Historically, whatever the golfer chose to bring along was generally placed in a golf bag and the golfer had to carry the heavy bag, or hire a caddy to carry it for him (or her). Golf bags have been used for many years, but they are better suited for carrying essential golf equipment. A golfer may pack an extra shirt, cap, or pair of socks in a golf bag, but there is room for little else because the equipment usually fills the bag. Some golfers use a pull cart having wheels to pull their golf bag along, but the size and weight of the golf bag is still a concern.

Since the advent of motorized golf carts, golfers have been able to carry more of their desired items. Golf carts are designed to carry a golfer and a golf bag, or even two golfers and two golf bags. Golf carts often have a basket in which a golfer can place his or her "street" shoes, extra clothing, or a cooler. The basket suffers many shortcomings, however. Clothing can become wet if a golfer is caught in a rain storm. Items can bounce out of the basket and be lost if the golf cart is driven off the cart path into the ungroomed sections of the course (an all too frequent occurrence for most golfers). Thus, the need persists for a way to carry all the desired amenities of the game in a practical, secure, and convenient manner.

SUMMARY OF THE INVENTION

The present invention uses an innovative design to produce a storage cabinet for use on a golf cart having a body with an upper compartment and a lower compartment, the body being removably attached to and supported by the golf cart. The upper compartment comprises an upper open enclosure and an upper closure member, the upper closure member being releasably attached to the upper open enclosure. The lower compartment comprises a lower open enclosure and a lower closure member, the lower closure member being releasably attached to the lower open enclosure. Each closure member can be hinged to its respective enclosure. The body may have a platform between the lower compartment and the golf cart to raise the other compartments. The lower compartment has shelves. The shelves may be removable or fixed. Removable shelves can be placed at various heights within the lower compartment. The upper compartment is a thermally insulated container, or holds a thermally insulated container.

BRIEF DESCRIPTION OF THE DRAWINGS

So that the manner in which the described features, advantages and objects of the invention, as well as others which will become apparent, are attained and can be understood in detail, more particular description of the invention briefly summarized above may be had by reference to the embodiments thereof that are illustrated in the drawings, which drawings form a part of this specification. It is to be noted, however, that the appended drawings illustrate only typical preferred embodiments of the invention and are therefore not to be considered limiting of its scope as the invention may admit to other equally effective embodiments.

In the drawings.

DETAILED DESCRIPTION

Figure 1:
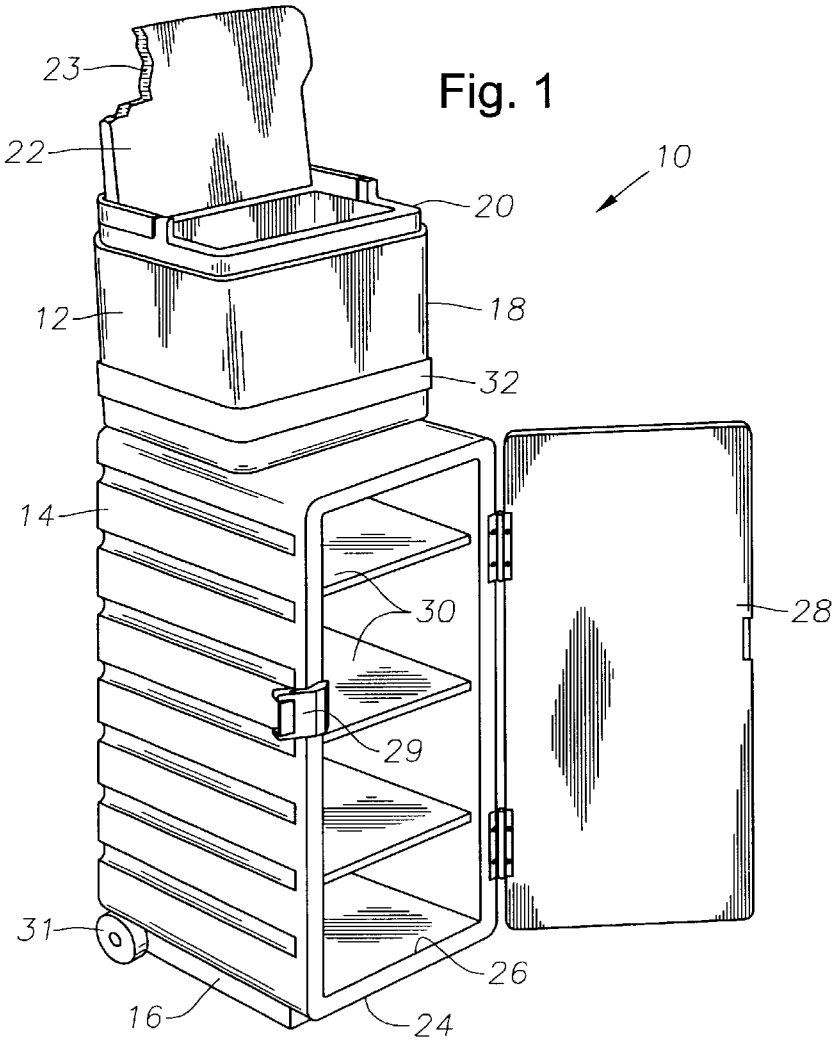
FIG. 1 is an orthogonal view illustrating a storage cabinet for use in a golf cart in accordance with the present invention.

FIG. 1 shows an embodiment of a storage cabinet 10 for use in a golf cart 11 (FIG. 3) in accordance with the present invention. Golf cart 11 is a conventional motorized vehicle having a seat for a driver 13. The storage cabinet 10 comprises a unitary body with two primary compartments 12 and 14 and a base 16. Upper compartment 12 sits atop lower compartment 14, the bottom of upper compartment 12 being rigidly attached to the top of lower compartment 14. Lower compartment 14 sits atop base 16, the bottom of lower compartment 14 being rigidly attached to the top of base 16.

Figure 2:
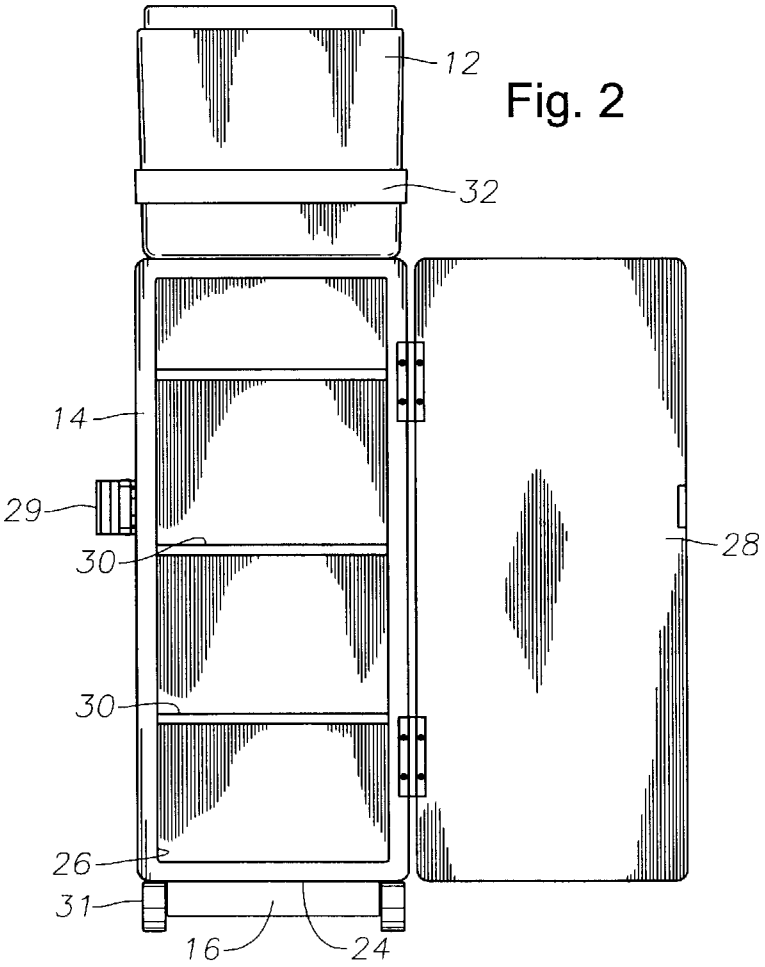
FIG. 2 is a front view of the storage cabinet of FIG. 1.

Upper compartment 12 comprises a double-walled container, preferably of approximately rectangular dimensions similar to a box, having an outer wall 18, an inner wall 20, and a hollow lid 22, as shown in FIG. 1. The outer and inner walls 18 and 20, and the lid 22, are made of a durable, yet lightweight, material such as a hard plastic. Between the outer and inner walls 18 and 20, and in the hollow of lid 22, lies a thermally insulating material 23 such as polystyrene plastic. The lid 22 forms the top of upper compartment 12 and is pivotally attached to the back wall of upper compartment 12. When the lid 22 is closed, as shown in FIG. 2, the interior of upper compartment 12 is thermally insulated from the surrounding environment. Thus, upper compartment 12 can be used to store and transport chilled beverages or heated food items. When pivoted to its open position (FIG. 1), the lid 22 allows for easy insertion or removal of the upper compartment contents. Upper compartment 12 can also have a drain plug (not shown) to allow for easy disposal of water accumulated from ice melt.

In an alternate embodiment (not shown), rather than a thermally insulated upper compartment 12, a commercially available thermally insulated cooler will slide into a supporting enclosure formed on the upper end of lower compartment 14. In that embodiment, there is no separate lid 22; rather the cooler will have a lid. The supporting enclosure has no top, thus the cooler can slide in or out of the enclosure. The cooler thus becomes the upper compartment in the alternate embodiment.

Lower compartment 14 similarly comprises a container, preferably of approximately rectangular dimensions similar to a box, having an exterior wall 24, an interior wall 26, and a door 28. The exterior and interior walls 24 and 26 and the door 28 are preferably made of hard plastic. The space between the exterior and interior walls 24 and 26 may be solid fill or it may be a hollow air space, so long as structural rigidity is maintained. Similarly, the door 28 may be solid or it may enclose a hollow air space, so long as structural rigidity is maintained. The door 28 forms the front of lower compartment 14 and is pivotally attached to a side of lower compartment 14. Door 28, when closed, is held shut by a latch, strap, or some other releasable fastener 29.

The interior of lower compartment 14 is subdivided into smaller compartments by shelves 30. The shelves 30 can be used to separately store clothing, shoes, towels, golf balls, or other items a golfer may consider useful on the golf course. The shelves 30 are constructed of sturdy, lightweight material such as hard plastic or wood and may be integral to lower compartment 14, but are preferably supported directly or indirectly by interior wall 26. For example, interior wall 26 may incorporate several short ledges protruding slightly into the interior region of lower compartment 14, or it may have various tabs mounted to it on which shelves 30 may be secured. Shelves 30 are removable and can be spaced to accommodate variously shaped items.

Figure 3:
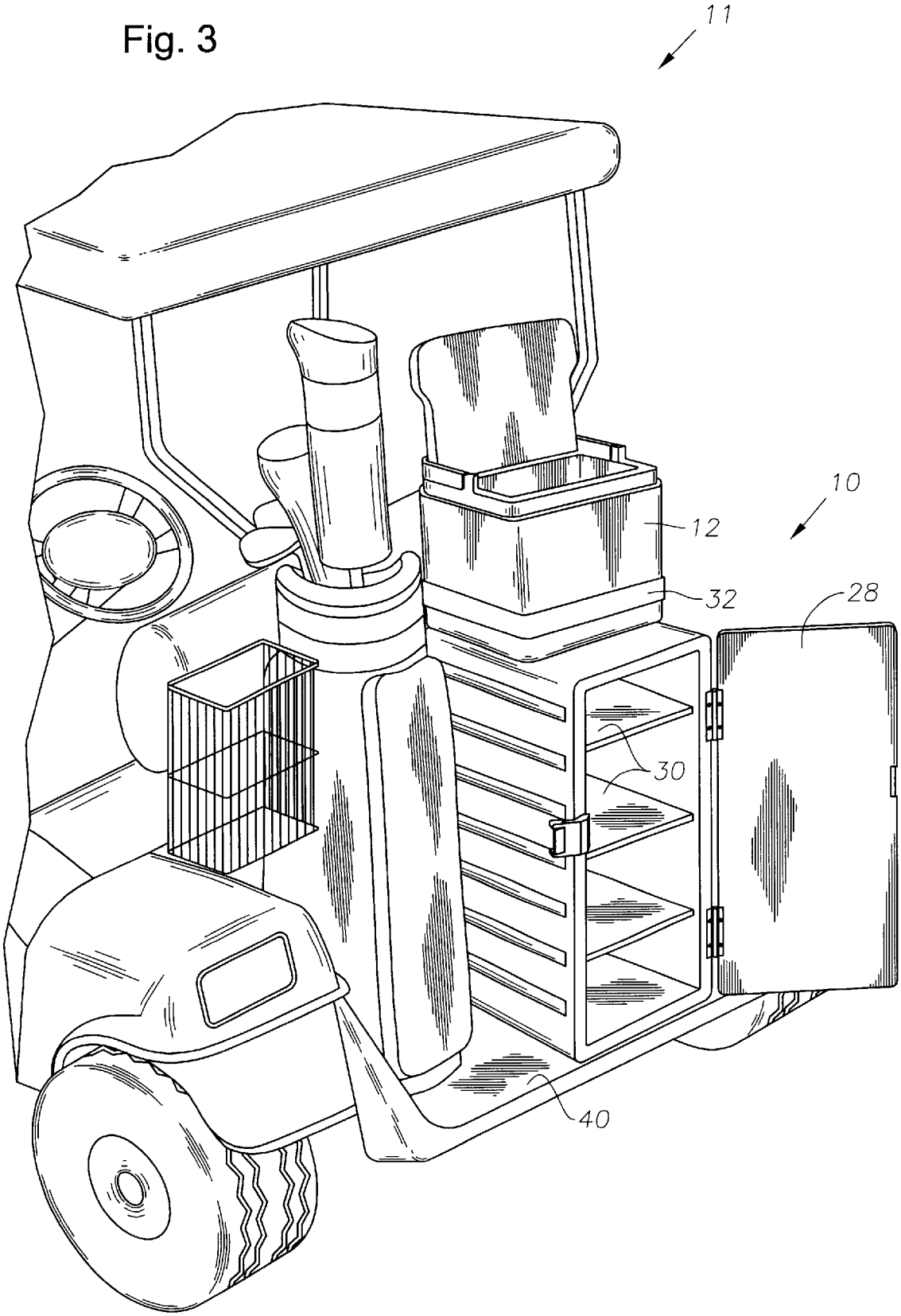
FIG. 3 is an orthogonal view of the storage cabinet of FIG. 1 without a base, showing the storage cabinet in relation to a golf cart.

As stated above, a base 16 is rigidly attached to lower compartment 14. Base 16 serves to slightly elevate compartments 12 and 14 and supports the entire load of the filled storage cabinet 10. Base 16 is optional and FIG. 3 shows an embodiment in which base 16 is omitted. However, use of base 16 more easily allows incorporation of wheels 31 so that storage cabinet 10 can be rolled to or from the golf cart 11. Also, by slightly raising lower compartment 14, base 16 protects against accidental influx of water or fine debris that may accumulate on the supporting rear ledge 40 of the golf cart 11.

The overall size of storage cabinet 10 of the preferred embodiment is approximately that of a standard golf bag. As FIG. 3 illustrates, the storage cabinet 10 essentially fills the space normally allocated for the golf bag of a player sharing the golf cart 11 with the driver of the cart 11. The storage cabinet 10 is sized and shaped to rest upon the rear ledge 40 of the cart 11. The storage cabinet 10 would normally have a footprint no larger than one-half of the area of ledge 40. The storage cabinet 10 is secured to the cart 11 with a strap 32 pulled snugly around upper compartment 12 and fixed to the cart 11.

The present invention offers many advantages over the prior art. Extra clothing is protected from the elements and can be organized for ready access. Because the clothing or other stored items are kept in an enclosed cabinet, they are less likely to be lost when jostling through the rough. With the abundance of storage space, a golfer can bring more contingent items that would otherwise be left behind based on the golfer's assessment, usually hours in advance, that a particular item will most likely not be needed. A secure insulated container provides a safer environment for food that could otherwise spoil in the heat.

While the invention has been particularly shown and described with reference to a preferred and alternative embodiments, it will be understood by those skilled in the art that various changes in form and detail may be made therein without departing from the spirit and scope of the invention.

What is claimed is:

1. In a golf cart having a seat for a driver and a rearward ledge for supporting a golf bag, the improvement comprising:

a golf cart storage cabinet including a rectangular storage compartment having a lower end that is supported on the rearward ledge, an upper end, a forward wall and a rearward wall, and two side walls, the compartment having a width between the two side walls that is not greater than one-half of a width of the rearward ledge, to enable a golf bag to be placed on the rearward ledge beside the compartment;

a door on the rearward wall for providing access to an interior of the compartment; and a strap extending around the cabinet for releasably fastening the cabinet to the golf cart.

2. The golf cart of claim 1 further comprising a thermally insulated container on the upper end of the compartment for holding beverages.

3. The golf cart of claim 1 further comprising at least one shelf mounted in the compartment.

4. The golf cart of claim further comprising a set of wheels mounted to the compartment for rolling the compartment.

5. A golf cart comprising:

a cart body mounted on wheels having a seat for a driver and a lower ledge behind the seat for supporting a golf bag;

a storage cabinet positioned upon the lower ledge;

the storage cabinet having an open end wall and a movable closure member over the open end wall, the storage cabinet having at least one shelf for storing articles therein;

the storage cabinet having a width that is not greater than one-half of a width of the lower ledge to provide room on the lower ledge for receiving a golf bag; and a strap extended around the cabinet for releasably securing the cabinet to the golf cart.

6. The golf cart of claim 5 in which the shelf is removable from the cabinet.

7. The golf cart of claim 5 wherein the cabinet is substantially rectangular.

8. The golf cart of claim 5, further comprising an ice chest on an upper end of the cabinet.

9. A method of using a golf cart to maintain ready access to items while golfing, comprising the steps of:

providing a golf cart storage cabinet including a rectangular storage compartment having a lower end, an upper end, a forward wall, rearward wall, a door on the rearward wall, two side walls, and a width between the two side walls that is not greater than one-half of a width of a rearward ledge of the golf cart, to be positioned upon the rearward ledge;

securing the cabinet to the rearward ledge of the golf cart;

securing a golf bag on the rearward ledge of the golf cart along side the cabinet;

opening the door and storing items in the cabinet;

operating the golf cart on a golf course; and accessing the items in the cabinet, as needed.

* * * * *